United States Patent [19]

Murakami et al.

[11] Patent Number: 4,774,110

[45] Date of Patent: Sep. 27, 1988

[54] NON-WOVEN FABRIC AND METHOD FOR PRODUCING SAME

[75] Inventors: Kakuji Murakami, Kurita; Takashi Nakayama; Atsumi Morioka, both of Otsu, all of Japan

[73] Assignee: Toray Industries, Inc., Tokyo, Japan

[21] Appl. No.: 112,686

[22] Filed: Oct. 23, 1987

Related U.S. Application Data

[62] Division of Ser. No. 900,075, Aug. 15, 1986, Pat. No. 4,735,849.

[30] Foreign Application Priority Data

Aug. 26, 1985 [JP] Japan ..... 60-185905
Sep. 27, 1985 [JP] Japan ..... 60-212278

[51] Int. Cl.[4] ..... B05D 3/12

[52] U.S. Cl. ..... 427/365; 28/104; 28/112; 156/153; 156/252; 427/322

[58] Field of Search ..... 427/322, 365; 156/153, 156/152; 28/104, 112

[56] References Cited

U.S. PATENT DOCUMENTS

| | | | |
|---|---|---|---|
| 3,494,821 | 2/1970 | Evans | 428/224 |
| 4,245,001 | 1/1981 | Phillips et al. | 428/224 |
| 4,331,724 | 5/1982 | Su | 428/399 |
| 4,576,858 | 3/1986 | Fowezon | 428/300 |
| 4,612,228 | 9/1986 | Kato et al. | 428/299 |
| 4,623,575 | 11/1986 | Brooks et al. | 428/131 |

FOREIGN PATENT DOCUMENTS

| | | | |
|---|---|---|---|
| 748445 | 10/1970 | Belgium | 28/104 |
| 0066554 | 4/1984 | Japan | 28/104 |

*Primary Examiner*—James J. Bell
*Attorney, Agent, or Firm*—Austin R. Miller

[57] ABSTRACT

A non-woven fabric suitable for clothing manufacture, comprising a fiber web substantially formed of a continuous filament of a synthetic fiber, wherein a plurality of weakened portions in a form of a scratch or a crack are distributed on the filament constituting at least one surface of the fiber web. Some of the weakened portions are broken to form free ends, some of which are projected from the fabrice surface to form a short fluff, and some of the remaining ends are embedded in the interior of the fiber web and entangled with the filament. The weakened portions of the filament are provided by nipping the fiber web between a pair of rollers, at least one of which has a rough surface formed of a plurality of prominences of hard particles. A punching treatment of the fiber web after the weakened portions has been imparted is effective for breaking the filament to form short fluffs on the fabric surface and for entangling the filaments with each other. A resin treatment before the punching treatment is also favorable.

7 Claims, 10 Drawing Sheets

NON-WOVEN FABRIC AND METHOD FOR PRODUCING SAME

This is a division of application Ser. No. 900,075 filed Aug. 15, 1986, U.S. Pat. No. 4,735,849.

BACKGROUND OF THE INVENTION

1. Field of the Invention

The present invention relates to a unique non-woven fabric and a method for producing the same, particularly, to a non-woven fabric formed of a continuous filament of synthetic fiber, having a structure and an appearance as if staple fibers are mixed therewith and having an excellent softness and pilling resistance suitable for high class clothing, and a method for producing the same.

2. Description of the Prior Arts

In the past, a typical non-woven fabric was a felt utilizing a milling property of wool. Since then, many non-woven fabrics formed of a web of synthetic staple fibers or a layered sheet of synthetic filament fibers having a non-milling property have been proposed, which web or sheet is punched by needles or water jets to cause the composing fibers to become entangled.

Some of these non-woven fabrics are used as a final product without further treatment, and the others are post-treated to strengthen the mutual entanglement or bonding between fibers by resin impregnation or by press-heating.

The production system using the staple fiber web as a starting material has an advantage in that fibers are easily entangled by needle-punching or the like. This system, however, has a drawback in that a web having a uniform thickness is not easily produced from a lump of staple fibers through a carding engine, especially when the fibers are long staple fibers of ultra-fine denier suitable for clothing manufacture. In this case, the resultant web has an uneven quality and many cloudy portions where the fibers are not fully separated from each other. Thus, this problem constitutes a bar to the production of a non-woven fabric having light weight, excellent softness and uniform thickness. Especially, when the fiber web is resin-coated, a resin membrance is unevenly formed on the web surface, and thus the reinforcement effect of the resin-coating can not be attained.

To improve the softness of the non-woven fabric for the manufacture of clothing, various methods have been proposed. For example, a fiber web is prepared by a composite fiber having an island-in-sea type structure and, thereafter, the sea component of the fiber is removed so that the island component remains as an ultra-fine fiber, or alternatively, a web is prepared by a splittable conjugated fiber composed of different kinds of polymers and is post-treated to divide the conjugated fiber into the individual components. These techniques, however, require a sophisticated spinneret structure for extruding such a composite fiber, which tends to make production management difficult. Moreover, an additional process is required for obtaining the component fiber from the original fiber. Thus, the process becomes complicated and the production cost very expensive.

According to a system for the production of a layered web sheet from a continuous filament fiber spun directly from a spinneret, usually referred to as "a spun bond system", an ultra-fine fiber such as that one having a 0.5 denier is usable because the fiber thickness has little influence on the evenness of the resultant fiber web relative to the former system using a staple fiber web prepared from a carding engine. Even in this system, however, the resultant non-woven fabric has a drawback in that the fibers in the fabric are liable to be displaced in the web when an external force is applied, since the migration and the mutual entanglement of the fibers are not enough even after they are subjected to powerful water-jet punching during the web forming process. This relatively loose structure of the fabric results in a tendency toward pilling or napping on the fabric surface and is one reason why the non-woven fabric obtained by the latter system is not utilized in the manufacture of clothing.

In general, to avoid the abovesaid pilling or the like, the fiber web forming the non-woven fabric is impregnated with a resin or is subjected to a heat-adhesion treatment to reinforce the bonding between the fibers composing the web. The fabric thus obtained, however, tends to lack the desired soft touch and to lose air-permeability, and in addition, a paper-like, annoying sound is generated when touched. These are fatal drawbacks for clothing manufacture, even though usable for industrial purposes.

SUMMARY OF THE INVENTION

It is a primary object of the present invention to eliminate the above drawbacks of the prior art and to provide a unique non-woven fabric and a method for producing the same, which fabric is highly resistant to "pilling" or "napping" and has an excellent weight reduction, drapery, resiliency and touch suitable for clothing manufacture.

It is a second object of the present invention to provide a non-woven fabric and a method for producing the same, which fabric has a further improved resistance to "pilling" or "napping" while retaining the other above favorable properties by a resin treatment using a lower volume of resin.

According to a first aspect of the present invention, there is provided a non-woven fabric suitable for clothing manufacture, comprising a fiber web formed substantially of a continuous filament of synthetic fiber, wherein a plurality of weakened portions in the form of scratches or cracks are distributed on the filament constituting at least one surface of the fiber web; some of the weakened portions being broken to form free ends; some of the free ends being projected from the fabric surface to form naps and some of the remaining ends being embedded in the interior of the fiber web and entangled with the filament.

According to a second aspect of the present invention, there is provided a method for producing the abovesaid non-woven fabric from a starting fiber web prepared by collecting a continuous filament of a synthetic fiber, comprising a weakening treatment in which the starting fiber web is nipped between a roller system or a plate system, at least one element of the system having a rough surface provided by a plurality of particles of hard material so that weakened portions are imparted to the filament constituting the surface of the fiber web, and a punching treatment, in which the fiber web is punched so that the filaments are entangled with each other. If necessary, a resin may be coated on or impregnated in the fiber sheet at the appropriate stage after the fiber web is formed.

BRIEF DESCRIPTION OF THE DRAWINGS

Other objects and advantages of the present invention will be apparent from the description of the preferred embodiments of the present invention illustrated in the attached drawings, wherein.

DESCRIPTION OF THE PREFERRED EMBODIMENTS

A non-woven fabric according to the present invention is mainly formed of a continuous filament spun from a fiber-forming polymer, such as polyethylene-terephthalate, polyamide, polyacrylonitrile, polyethylene, polypropylene, polysulfide-polyimido, or polybutylene-terephthalate, or a modified polymer thereof. The filament may be either a usual mono-component fiber or a multi-component composite fiber such as an island-in-sea type composite fiber or a splittable type conjugated fiber. Fibers of various cross sections may be used, including the usual circular or a non-circular sections.

Figure 6A:
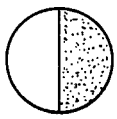
FIGS. 6A through 6D are cross sections of various conjugated composite fibers suitably utilized for the present invention, respectively.
Figure 6B:
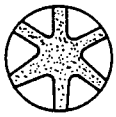
Figure 6C:
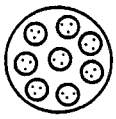
Figure 6D:
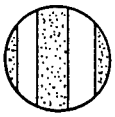
Figure 7:
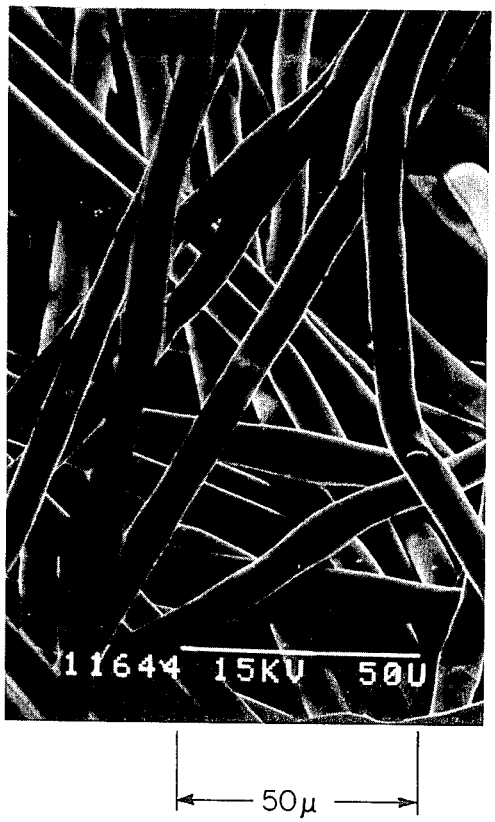
FIG. 7 is a microscopic photograph showing a surface of a starting fiber web having no weakened portions imparted by the present invention.
Figure 7B:
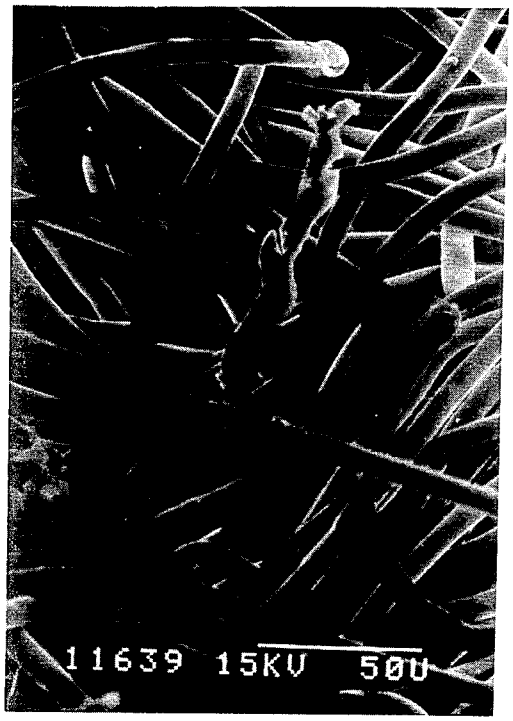
FIGS. 7A through 7D are microscopic photographs showing weakened portions and broken ends of fibers composing the non-woven fabric of the present invention.
Figure 7A:
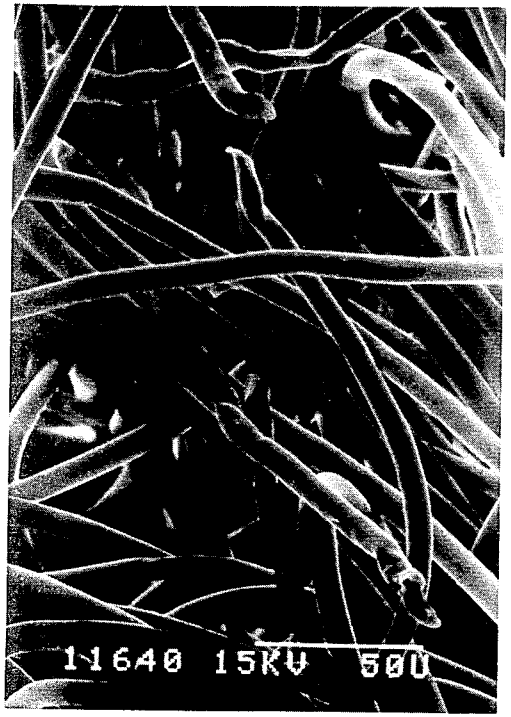
Figure 7D:
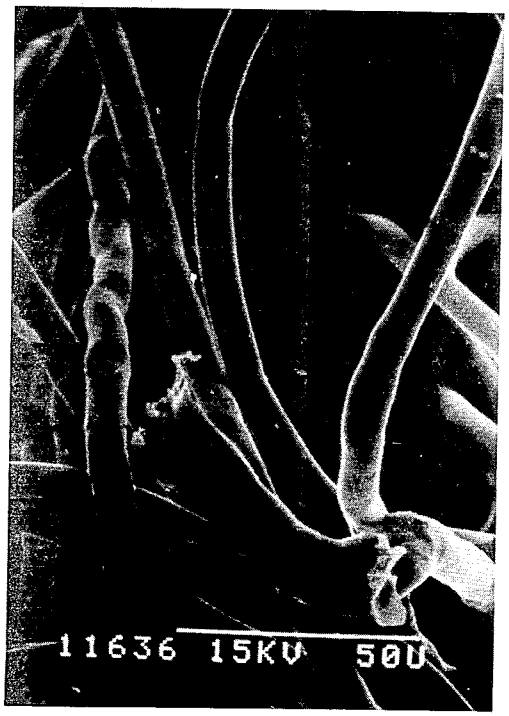
Figure 7C:
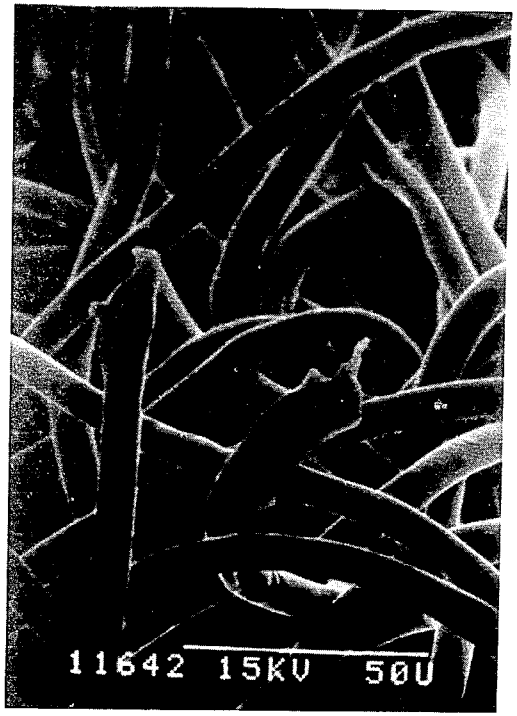

The abovesaid multi-component composite fiber includes a combination of different kinds of polymers such as polyethylene-terephthalate and polyamide, and a combination of polymers of the same kind having different intrinsic viscosities, of a regular polymer and a copolymer, or of polymers with and without additives. The typical cross sections of the composite fiber composed of multi-components are illustrated in FIGS. 6A through 6D, in which FIG. 6A shows a side-by-side type (conjugated type), FIG. 6B an orange type, FIG. 6C an island-in-sea type, and FIG. 6D a slit type. These composite fibers can be divided into individual components, each of which forms a generally very fine continuous filament. This splitting process is carried out, for example, by a chemical treatment in which one component of the composite fiber is dissolved by a certain agent, or a physical treatment in which pressure or punching is applied on the fiber to separate the individual components from each other. When using the above splittable composite fiber as a material filament, a resultant non-woven fabric according to the present invention has a very soft touch, although the present invention is not limited to the use of this type of filament. That is, a denier of the individual continuous filament applicable to the non-woven fabric according to the present invention can be selected from a wide range of from 0.01 denier to several ten denier, but the most suitable range is from 0.05 denier to 5 denier for the purpose of clothing manufacture. The fiber denier should be selected by taking the final property of the non-woven fabric into account. For example, if a soft touch is desired in the final product, the island-in-sea type composite fiber having individual island components of from 0.01 denier to 1.0 denier distributed in a sea component is preferably utilized, and the sea component removed after the grey non-woven fabric has been formed. Alternatively, the splittable composite fiber having individual components of from 0.05 denier to 5.0 denier is advantageously adopted, which fiber is split into individual micro-filaments after the grey non-woven fabric has been obtained. If the usual plain filament fiber composed of mono- or modified polymer is utilized, the thickness thereof should be 0.1 denier through 5 denier. Especially, when an ultra-fine fiber of, for example, 0.01 denier through 0.05 denier, is utilized, a preferable non-woven fabric having good resistance against "excess napping" can be obtained, because the fiber density in a fiber web forming the fabric can be increased to strengthen the entanglement between the fibers. Further, resistance against "pilling" is also improved, because fibers emerging on the fiber surface are easily broken without accompanying drag-out of the internal fiber when an external force is applied thereto. On the contrary, if the fiber denier becomes larger to an extent such that it exceeds, for example, 5 denier or more, the softness of the resutant fabric is adversely influenced.

A non-woven fabric according to the present invention is first prepared by a layered sheet of fiber web formed of the aforesaid continuous filament, which web is then subjected to a weakening treatment in which the filament constituting at least one surface of the sheet is imparted with weakened portions in the form of a crack or a scratch. The filament may be broken at some of the weakened portions to form an free end, which is sometimes embedded in the interior of the web due to migration and sometimes projected from the surface of the web as a favorable nap.

The non-woven fabric according to the present invention is produced from a starting fiber web mainly formed of a continuous filament by a unique method comprising a weakening treatment and a punching treatment.

Regarding the weakening treatment, the fiber web subjected to this weakening treatment may be either a simple layered web without fiber bonding or a provisionally bonded web. The roller system or plate system utilized for the weakening treatment preferably consists of a pair of elements in the form of a roller or plate, each of which element is engaged with the other to nip the fiber web therebetween. For continuous processing of the fiber web, the roller system is most preferable. At least one element of the pair has a rough surface for imparting a crack or scratch to the filament. This rough surface may be provided by an emery cloth or an emery paper. Alternatively, hard particles selected from a group including diamond, silicon carbide, boron carbide, crystalline aluminum oxide, zirconium oxide, garnet, quart, artificial diamond, artificial sapphire, silicon nitride, ceramics, alumina, titanium oxide, or glass may be directly coated on the element surface. In another aspect, the element may be molded from a material containing the above hard particles, which is buffed to form a plurality of prominences on the surface of the element. This rough surface element is pressed against one side or both sides of the web to form weakened portions on the filaments existing on the web surface.

The roughness of the rough surface should be in a range of from 1 μm through 5000 μm in average particle diameter, according to the study of the present inventor, and preferably from 50 μm through 500 μm, which range corresponds to an emery grade of from #40 to #600.

A nipping pressure should be varied in accordance with the physical properties of a fiber constituting the fiber web. The pressure is selected so that, when the filament is stretched during a subsequent punching treatment, the filament can be broken at at least part of the weakened portions. In other words, the intensity of the punching treatment should be such that the above-said filament breakage occurs. It must be noted that, according to the present invention, the weakened portion of the filament is not formed by "shearing" or "tearing", as in the case of a raising machine, but mainly by "cracks" or "scratches" as stated before and as shown in FIGS. 7A through 7D. The weakening treatment may be carried out immediately after the web is formed (in this stage, the web has substantially no mutual entanglement), or after the provisional (preliminary) entanglement is imparted. In this regards, the provisional entanglement of the web fiber is provided by calendering, heat-embossing, needle punching, water jet punching or the like. The combination of the punching treatment and the weakening treatment may be repeated twice or more. In another aspect, after the preliminary punching treatment, a resin may be impregnated in the fiber web and, thereafter, the weakening treatment may be repeated. Altervatively, after the punching treatment, a resin may be coated on or impregnated in the web and, thereafter, the weakening treatment may be carried out, which may be followed by a second punching treatment.

The weakening treatment is usually carried out at room temperature, but it may be possible to heat the pressing roller system or to heat the fiber web itself prior to the weakening treatment. The fiber web may be treated in a wet condition or a dry condition.

The punching treatment includes needle-punching and water jet-punching, in which the latter is most preferable because the product properties such as softness, etc., can be easily controlled. As stated before, the nipping pressure, by which the rough surface element is pressed against the web surface, is selected so that the weakened portions imparted can be easily broken by the water jet-punching. In the roller system, the nipping pressure is preferably in a range of from 0.01 kg/cm through 500 kg/cm along a nip length of the roller. The broken end of the filament caused by the punching migrates to the interior of the web from the punched surface together with the water jet or the needle and is entangled with the interior filament or filaments. Some of the broken ends emerge on the back surface of the web opposite to the punched surface, whereby a favorable nappy non-woven fabric can be obtained.

The thus obtained non-woven fabric may be used as a final product according to the present invention, or may be used as an intermediate product which will be a final product after being subjected to a post-treatment.

Regarding the resin-treatment effective for increasing the inter-fiber bonding, an impregnation or coating process using polyurethane resin or other is most popular, by which the touch and functional properties of the non-woven fabric can be improved to a great extent. Other than polyurethane, the following material may be utilized: polyvinyl alcohol, nitril-butadiene rubber, styrene-butadiene rubber, ethylene-propylenecopolymer, chlorosulfonated polyethylene, silicon resin, fluorine resin, polyvinyl acetate, polyvinyl chloride, polyamide, acrylic ester, amino acid, polyolefin, copolymer of polyethylene, and polyvinyl acetate.

Instead of the resin treatment, a stitch-bonding or a fusion-bonding of the starting fiber web may be applied for enhancing the inter-fiber bonding.

According to the punching treatment after the resin coating or impregnation, not only are the weakened portions of the filament broken but also the resin layer is perforated with a plurality of micro-pores, whereby the non-woven fabric thus obtained has an improved appearance and touch as well as an excellent air-permeability, just like a fabric made from staple fibers.

Where the resin treatment uses polyurethane, solidification of the resin may be carried out by either a wet system or a dry system. According to the former system, since the solidified resin forms a micro-porous honey-comb structure due to foaming, softness of the resultant fabric is improved. On the other hand, according to the latter dry system, a thinner membrance of the resin can be formed on the surface of the fabric because a solvent of the resin is evaporated in the air directly from the surface of the fabric. Thus, the resin treatment enhances the mutual bonding between the filaments and the resiliency of the fabric, which minimizes a residual elongation of the non-woven fabric and improves the durability of clothing manufactured from the fabric. The amount of the resin to be impregnated in the fabric is preferably in a range of from 99/1 through 20/80 of a weight ratio between a fabric and a resin, more preferably, from 95/5 through 70/30, if it is desired to maintain the softness of the grey fabric.

If the amount of the resin is less than 1%, an improvement of the resistance against pilling or napping cannot be attained, although the softness of the fabric is not changed. On the contrary, if the resin ratio exceeds 80%, the touch becomes harsh and the fabric is unsuitable for clothing manufacture.

Usual finishing treatments may be carried out in the final stage of processing, which finishing treatments include calendering, embossing, buffing (raising), and creasing or the like. These treatments may be applied to the fabric independently or in combination. Of course, these treatments may be combined with the abovesaid resin treatment. Calendering serves to improve the smoothness and luster of the surface of the fabric, and is effective for increasing the warmth-keeping property because the number of voids between the filaments is decreased. Embossing serves to impart surface variations of colour, touch, or luster to the fabric. Buffing (raising) enhances the plush-like effect and improves the touch of the fabric surface. Finally, creasing forms various wrinkles on the fabric surface, which can further the fashionability of the fabric.

The non-woven fabric according to the present invention is mainly constituted by a continuous filament fiber but may include a staple fiber as a small part thereof. The weight of the fabric is preferably in a range of from 10 g/m$^2$ through 300 g/m$^2$, more preferably, from 10 g/m$^2$ through 50 g/m$^2$.

The non-woven fabric according to the present invention has an excellent pilling resistance exceeding a third grade defined in a five-hour test by an I. C. I. method. In this regard, the I. C. I. method is widely used in the textile industry for estimation of pilling tendency of a knit or a woven fabric, in which first through fifth grades are defined as the pilling tendency is improved. This method is described ln detail in JIS (Japanese Industrial Standard) L 1076, method A. In the present invention, a resistance against excessive napping is also estimated from the appearance of the test pieces. The pill starts from an entanglement between fluffs on the surface of the fabric, which grows up to an undesirable nappy surface, then develops to a so-called pill because the interior fiber connected to the nap is dragged out of the interior of the fabric without breakage. The pill should be avoided because it degrades the appearance of the fabric. Particularly, since the non-woven fabric has a relatively loose fiber structure compared to a knit or a woven fabric formed of threads, the napping or pilling is liable to be generated in a shorter period compared to the latter. In addition, the non-woven fabric formed from a filament has an inferior mutual fiber entanglement to that formed from a staple fiber because it is difficult for the filament to migrate in the fabric, whereby once the adverse nap is formed on the fabric surface, the filament is withdrawn substantially in an endless manner from the interior of the fabric to form the larger pill.

To solve the above problem, according to the present invention, the filament is imparted with the weakened portions so that it can be broken when the stretching force is applied thereon during the formation of pilling. The resin treatment is also effective for increasing the inter-fiber restraint force.

With reference to FIGS. 1 through 4, the structural features of the non-woven fabric according to the present invention will be described in more detail relative to the conventional non-woven fabric.

Figure 2:
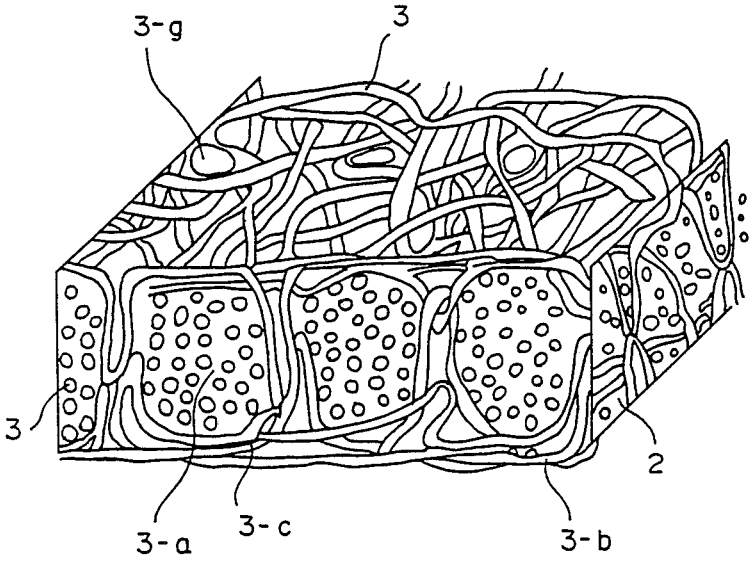
Fig. 2 PRIOR ART
FIG. 2 is a diagrammatic perspective view of the structure of a non-woven fabric according to the prior art.

First, the structure of the conventional non-woven fabric 2 formed from a continuous filament is explained with reference to FIG. 2, in which a continuous filament 3 constitutes a relatively parallel fiber bundle portion 3-*a*, a cloudy fiber portion 3-*b*, a loop-like migrated fiber portion 3-*c* caused by water jet-punching, and a micro-pore 3-*g* provided by the water jet-punching. According to this structure, the cloudy fiber portion 3-*b* on the both surfaces is very unstable and the number of the migrated fiber portions 3-*c* is very few.

Figure 1:
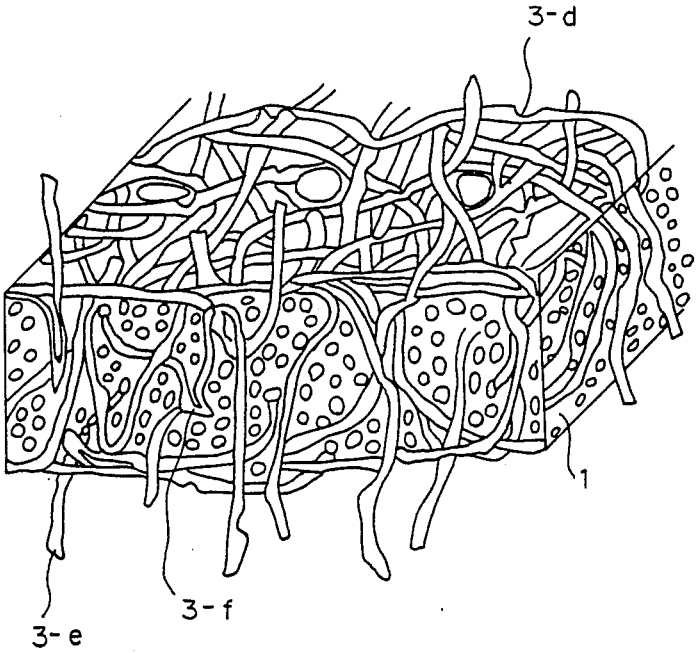
FIG. 1 is a diagrammatic perspective view of the structure of a non-woven fabric according to present invention.

FIG. 1 shows an example of the structure of the non-woven fabric 1 according to the present invention. The differences of this fabric 1 from that shown in FIG. 2 are that a plurality of weakened portions 3-*d* are distributed on one surface of the fabric 1, and that fluffs 3-*e* provided by the breakage of the filament 3 by water jet-punching and migrated fiber portions 3-*f* having free ends are mixed.

Figure 3A:
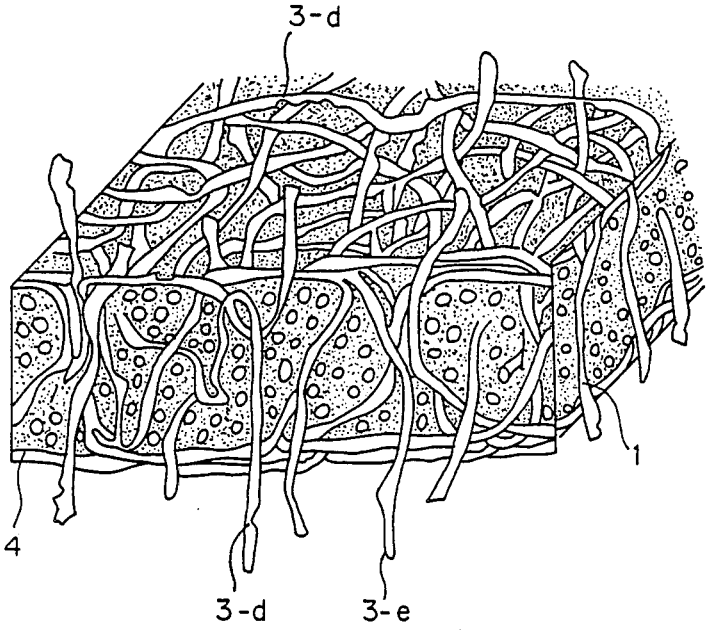
FIG. 3A is a diagrammatic perspective view of the structure of the non-woven fabric shown in FIG. 1, after complete impregnation of a resin.
Figure 3B:
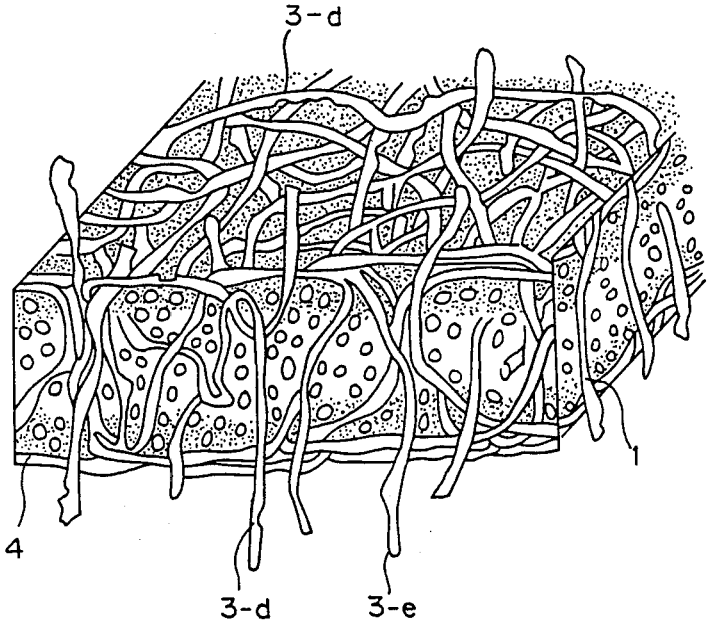
FIG. 3B is a diagrammatic perspective view of the structure of the non-woven fabric shown in FIG. 1, after partial impregration of a resin.

In FIGS. 3A and 3B, the non-woven fabric 1 is impregnated with a resin 4.

Figure 4:
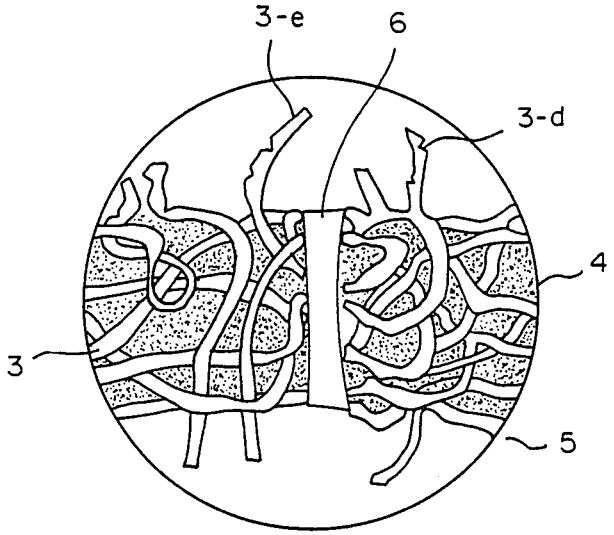
FIG. 4 is an enlarged sectional view of the structure of the non-woven fabric shown in FIG. 3A.

FIG. 4 illustrates an enlarged model of the structure of the non-woven fabric according to the present invention obtained by a combination of provisional punching by water jet, resin treating, weakening and, again, substantial punching by water jet. The resultant non-woven fabric 5 is provided with the weakened portions 3-*d* of the filament 3, the fluffs 3-*e*, and the micro-pores 6 randomly distributed over the fabric surface. According to the present inventor's study, the number of micro-pores 6 is preferably in a range of from 1/cm$^2$ through 300/cm$^2$. If this value exceeds the lower limit, the air permeability of the non-woven fabric becomes poor, and on the other hand, if the upper limit is exceeded, the physical strength of the fabric is decreased and the durability thereof is degraded.

Figure 5A:
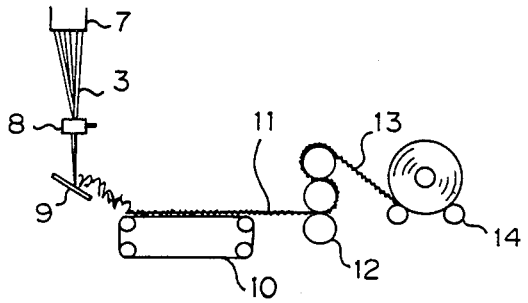
FIGS. 5A, 5B and 5C are diagrammatic side views of process arrangements for producing a non-woven fabric according to the present invention, respectively.
Figure 5B:
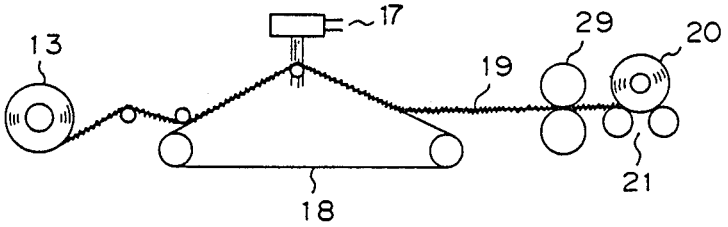
Figure 5C:
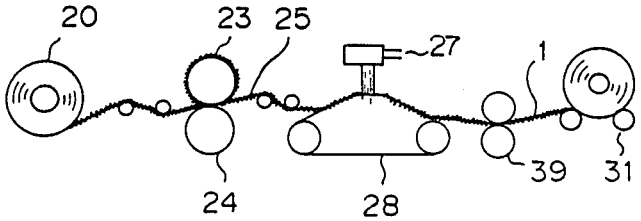

FIGS. 5A through 5C illustrate one of the preferred embodiments of the process for obtaining the non-woven fabric 1 according to the present invention shown in FIG. 1. As shown in FIG. 5A, a continuous filament 3 spun from a spinner 7 is withdrawn by means of an ejector 8 while subjected to the drawing operation, and is collected on a net conveyer 10 to form a fiber sheet 11 after impinging on a baffle plate 9. Then, the fiber sheet 11 is wound up on a take-up roll 14 as a starting fibr web 13. As shown in FIG. 5B, the fiber web 13 is subjected to a high pressure water jet from a water-jet punching unit 17 while being conveyed by a net conveyer 18, whereby a preliminarily punching treatment is carried out. The thus-obtained preliminarily entangled non-woven fabric 20 is wound up on a take-up roll 21 after dehydration by a squeezing roller 29. This non-woven fabric 20 is continuously fed into a nip zone between a rough surface roller 23 having a plurality of prominences formed of hard particles on the surface and a smooth surface roller 24, as shown in FIG. 5C, whereby weakened portions are imparted to one side of the fabric 20 in contact with the rough surface roller 23. The thus-obtained non-woven fabric 25 having the weakened portions is introduced again into a punching unit 27 having substantially the same function as the aforesaid water-jet punching unit 17 while being carried by a net conveyer 28, by which the substantial entanglement treatment is carried out, and is finally wound up on a take-up roll 31, after passing through a squeezing roller 39, as a final non-woven fabric 1 according to the present invention. It should be noted that the filament 3 constituting the non-woven fabric is broken to form free ends, some of which project outside to form the fluffs 3-*e*, and others are embedded in the interior of the fabric during the substantial entanglement treatment shown in FIG. 5C.

The process shown in FIG. 5C may be repeated twice or more. Further, in the abovesaid process, the intermediate take-ups of the non-woven fabrics 13 and 20 may be eliminated, that is, the process can be carried out continuously without interruption. Alternatively, the buffing (raising) treatment may be added in the process, for example, prior to the entanglement treatment. If it is desired to obtain the non-woven fabric shown in FIG. 4, the resin treatment may be incorporated in the process prior to the substantial entanglement treatment shown in FIG. 5C.

As described above, according to the present invention, although the starting material of the fabric is mainly a continuous filament fiber, the resultant fabric has a soft touch and an improved resistance against pilling the same as a fabric composed of a staple fiber, while maintaining the desirable properties of the fibrous material such as a light weight, a warmth-keeping property, drapeability, and resiliency, which are inherent to a non-woven fabric. Thus, the present invention provides a novel non-woven fabric that can be utilized for the high class clothing manufacture.

An additional effect is obtained from the weakening treatment when a splittable filament such as an island-in-sea type conjugated fiber is used. Due to the cracks or scratches on the filament caused by the weakening treatment, a considerable amount of the conjugated fiber is liable to divide into a sea component and an island component during the succeeding entanglement treatment, by which the sea component will be easily dissolved when the resultant fabric is subjected to a sea component removing treatment for obtaining the island component only. Further, due to this fiber splitting, the individual island components can be entangled even in a grey fabric, whereby the entanglement degree is improved. On the other hand, in the conventional method, since such a preliminary fiber split does not occur, the fibers are entangled while retaining a bundle form including both the sea component and the island component. In other words, the entanglement degree becomes poor. According to the above high entanglement degree, the non-woven fabric of the present invention needs a less amount of resin even if the resin treatment is necessary, which enhances the softness and air-permeability of the fabric. Regarding the air-permeability, the non-woven fabric shown in FIG. 4 obtained by a series of steps of the first punching treatment of the starting fiber web, the resin-treatment, the weakening treatment, and the second punching treatment is particularly excellent in this property.

The effects of the present invention will be more apparent from the following examples:

In the Examples, the estimation of test pieces was carried out according to the procedures defined in the following JIS (Japanese Indusrial Standard):

1. Pilling resistance: L 1076, Testing Method for Pilling of Woven Fabric and Knitted Fabric, Test A (I.C.I method);
2. Stiffness: L 1079, Testing Method for Stiffness of Woven Fabric and Knitted Fabric, Test A (45° cantilever method);
3. Air permeability: L 1096, Testing Method for Fabrics, Testing Method for Air Permeability, Test A.

EXAMPLE 1

A fiber web having a weight of 50 g/m$^2$ was prepared by a filament fiber of polyamide with thickness of 0.5 denier spun at a high rate by the process shown in FIG. 5A. The fiber web was subjected to a preliminary punching treatment by means of the process shown in FIG. 5B, wherein the nozzle diameter was 0.14 mm, the nozzle pitch was 1.1 mm and the water pressure was 40 kg/cm$^2$.

Then, one surface of the fiber web was subjected to a weakening treatment using a pair of pressing rollers, one of which had a rough surface provided by an emery cloth of #100 mesh, under a nipping pressure of 55 kg/cm$^2$ along a length of the roller. This treatment was repeated twice.

Thereafter, the weakened surface of the fiber web was subjected twice to a substantial punching treatment by using the same water-jet punching unit as before under water pressures of 60 kg/cm$^2$ and 70 kg/cm$^2$, respectively. This punching treatment was repeated once on the other surface of the fiber web under a water pressure of 60 kg/cm$^2$. These punching treatments were carried out at a processing speed of 1.7 m/min.

The thus-obtained non-woven fabric was subjected to a resin treatment after drying, in which polyurethane resin was impregnated in the fabric with a weight ratio of fabric/resin=78/22. Finally, both surfaces of the fabric were subjected to a calender treatment and to a finishing treatment after dyeing.

The resultant fabric had a rich softness due to fluffs and had a mild luster as well as a good resiliency.

For the comparison of pilling resistance, a blank was prepared by the same process as before except for the elimination of the weakening treatment. The test results were listed on Table 1.

As apparent from Table 1, the non-woven fabric showed a satisfying practical performance compared to the conventional product.

TABLE 1

| Test Period (hour) | Pilling Resistance Present Invention (grade) | Blank |
|---|---|---|
| 1 | 4–5 | 2 |
| 3 | 4–5 | 1–2 |
| 5 | 4–5 | 1 |
| 7 | 5 | 1 |
| 10 | 5 | 1 |
| 20 | 5 | 1 |

*Remarks:
There was no excessive napping tendency in the present invention, but a remarkable tendency thereto in the blank.

EXAMPLE 2

A starting fiber web was prepared and subjected to a preliminary punching treatment by the same process as in Example 1. A weakening treatment was repeated four times on each surface of the fiber web by using the same pair of rollers as before under a nipping pressure of 20 kg/cm. Thereafter, a substantial punching treatment was carried out under the same conditions as Example 1 except for the processing speed of 4.0 m/min. The thus-obtained non-woven fabric was dyed by means of spray printing or multi-color printing, after drying, and was impregnated with polyurethane resin with a weight ratio of fabric/resin=88/22. After calender treatment, the printed non-woven fabric of smooth surface was obtained. The resultant fabric exhibited a clear print pattern and a rich softness due to fluffs, and had a mild luster as well as a good resiliency. For a comparison of the pilling resistance, a blank was prepared by the same process a before except for the elimination of the weakening treatment. The test results were listed on Table 2.

As apparent from Table 2, the non-woven fabric showed a satisfying practical performance compared to the conventional product. Especially, resistances against laundering, sweat, and sun shine were also improved to a level satisfactory for practical use due to a coating of urethane resin.

TABLE 2

| Test Period (hour) | Pilling Resistance Present Invention (grade) | Blank |
|---|---|---|
| 1 | 4–5 | 2 |
| 3 | 4–5 | 1–2 |
| 5 | 4–5 | 1 |
| 7 | 4 | 1 |
| 10 | 3 | 1 |
| 20 | 3 | 1 |

*Remarks:
There was no excessive napping tendency in the present invention, but a remarkable tendency thereto in the blank.

EXAMPLE 3

A fiber web was prepared, provisionally punched, weakened, and substantially punched by the same process as in Example 2 except that the rough surface of the roller was prepared by coating thereon artificial diamond particles of #170. The obtained non-woven fabric was subjected to a first resin treatment of polyurethane resin coating and dip-dyed. Thereafter, a final resin treatment was carried out by using a gravure coater, whereby a weight of resin impregnated in the fabric was 18.3% relative to the total weight of the obtained fabric. Finally, the non-woven fabric was finished by an embossing machine, whereby a fine silk-like weaving pattern was imparted on the fabric surface.

Similar to the preceding Examples, a blank was prepared for comparison of ther pilling resistance; the test results being shown in Table 3.

TABLE 3

| Test Period (hour) | Pilling Resistance Present Invention (grade) | Blank |
|---|---|---|
| 1 | 4–5 | 2 |
| 3 | 4–5 | 1–2 |
| 5 | 4–5 | 1–2 |
| 7 | 3–4 | 1 |
| 10 | 3 | 1 |
| 20 | 3 | 1 |

*Remarks:
There was no excessive napping tendency in the present invention, but a remarkable tendency thereto in the blank.

EXAMPLE 4

A fiber web having a weight of 65 g/m$^2$ was prepared by a filament fiber of polyethylene-terephthalate of 1.3 denier spun at a high rate by the process shown in FIG. 5A. Both surfaces of the fiber web were subjected to a first weakening treatment at a processing speed of 2.0 m/min by a pressing action of a pair of rollers, both of which had a rough surface provided by an emery cloth of #400, under a nipping pressure of 45 kg/cm along a length of the roller. Then, a first punching treatment was carried out by a water jet-punching unit (nozzle diameter: 0.14 mm, nozzle pitch: 1.0 mm) under a water pressure of 30 kg/cm$^2$. The above weakening and punching treatments were repeated three times, in which the water pressure of the water jet punching were sequentially set at 50 kg/cm$^2$, 70 kg/cm$^2$ and 80 kg/cm$^2$ as the treatment progressed.

Thus obtained fabric was subjected to a resin treatment of polyurethane resin in a dry system, and to an embossing treatment for imparting a fine silk-like weaving pattern on the fabric surface.

The resultant non-woven fabric was light in weight and had excellent in warmth-keeping property different from the ordinary knit or woven fabric.

For a comparison of the pilling resistance, a blank was prepared by the same process as before except for elimination of the weakening treatment. The test results are listed in Table 4.

TABLE 4

| Test Period (hour) | Pilling Resistance Present Invention (grade) | Blank |
|---|---|---|
| 1 | 4 | 2–3 |
| 3 | 4–5 | 2 |
| 5 | 4–5 | 1–2 |

TABLE 4-continued

| Test Period (hour) | Pilling Resistance Present Invention (grade) | Blank |
|---|---|---|
| 7 | 4–5 | 1 |
| 10 | 5 | 1 |
| 20 | 5 | 1 |

*Remarks:
There was no excessive napping tendency in the present invention, but a remarkable tendency thereto in the blank.

EXAMPLE 5

A starting fiber web was prepared in the same manner as Example 1. The fiber web was subjected to a preliminary punching treatment by the identical unit as utilized in Example 4, which was repeated three times while varying the water pressure to 30 kg/cm$^2$, 50 kg/cm$^2$, and 85 kg/cm$^2$ at a processing speed of 1.5 m/min. After impregnation of polyurethane resin by a wet system (a weight ratio of fabric/resin was 70/30), both surfaces of the fiber web were subjected to a weakening treatment by a pressing action of a pair of rollers, each of which had a rough surface provided by buffing of alumina ceramic, under a nipping pressure of 17 kg/cm along a length of the roller. Then, a substantial punching treatment was repeated three times by the abovesaid punching unit while varying a water pressure to 60 kg/cm$^2$, 70 kg/cm$^2$, and 80 kg/cm$^2$, respectively, whereby the membrance of the resin was broken to form a plurality of pores through the fabric. Thus, the non-woven fabric shown in FIG. 4 was obtained, which had a plurality of short fluffs on the surface and a rich softness and air-permeability. A pilling resistance of this fabric was between the 4th and 5th grades after a 5 hour test, and 4th grade after a 10 hour test according to the I.C.I method.

EXAMPLE 6

A starting fiber web of 150 g/m$^2$ weight was prepared by an island-in-sea type conjugated fiber of 2.8 denier, each filament being composed of 36 island components of polyethylene-terephthalate of 0.1 denier and a sea component of polystyrene. A preliminary punching treatment was carried out by a water-jet punching unit (nozzle diameter: 0.21 mm, nozzle pitch: 1.2 mm) under a water pressure of 40 kg/cm. Then, a weakening treatment and a substantial punching treatment were repeated twice. At the first stage, the weakening treatment was done by a pair of nip rollers, one of which had a rough surface provided by an emery cloth of #80, under a nipping pressure of 80 kg/cm along a length of the roller. The substantial punching treatment was carried out in the same manner as the preliminary punching treatment except for a water pressure of 65 kg/cm$^2$. According to the first combination of the two treatments, 15% of polystyrene was removed. At the second stage, the weakening treatment was carried out under a nipping pressure of 100 kg/cm while using a rough surface roller provided with an emery cloth of #150. The substantial punching treatment was carried out under a water pressure of 85 kg/cm$^2$. According to the second stage, an amount of the remaining polystyrene was 68%, which means that a considerable part of the polystyrene component in the filament was destroyed. Thereafter, the non-woven fabric was subjected to a sea component removing treatment, in which the fabric was repeatedly impregnated with trichloroethylene followed by squeezing three times. The obtained fabric was subjected to a resin treatment and impregnated with polyurethane resin so that a weight ratio of fabric/resin was 74/26. Finally, the resultant fabric was buffed and sheared to a finished cloth state. The non-woven fabric thus obtained was remarkable, having a compact structure due to full entanglement of the filament and a very soft surface due to micro-fluffs.

For the comparison of a pilling resistance, a blank was prepared in the same manner as the preceding Examples. The test results are listed on Table 5.

TABLE 5

| Test Period (hour) | Pilling Resistance (grade) Present Invention | Blank |
|---|---|---|
| 1 | 4–5 | 3–4 |
| 3 | 5 | 3 |
| 5 | 5 | 3 |
| 7 | 5 | 3 |
| 10 | 5 | 2–3 |
| 20 | 4–5 | 2 |

*Remarks:
There was no excessive napping tendency in the present invention, but somewhat of a tendency thereto in the blank.

EXAMPLE 7

A first starting fiber web of 60 g/m$^2$ was prepared from a polyamide filament of 1.0 denier, which was layered on a second fiber web of 40 g/m$^2$ formed of a cotton staple fiber. The combination fiber web was subjected to a preliminary punching treatment by a water-jet punching unit (nozzle diameter: 0.14 mm, pitch 1 mm) under a water pressure of 30 kg/cm$^2$ and 60 kg/cm$^2$. The thus-obtained non-woven fabric was subjected to a weakening treatment twice on the filament side thereof by a pressing action of a pair of rollers, one of which had a rough surface coated with diamond particles and the other had a smooth surface made from rubber having a hardness of 80, under a nipping pressure of 30 kg/cm along a length of the roller. Then, a substantial punching treatment was carried out twice by the above punching unit under a water pressure of 65 kg/cm$^2$. A dyed product of this non-woven fabric had a favorable appearance with a natural crease on the surface of the cotton side. Further, the dyed fabric was subjected to a resin treatment of impregnation of polyurethane resin so that a weight ratio of fabric/resin was 91/9. The dyed fabrics before and after the resin treatment were estimated with regard to pilling resistance, and the test results are listed in Table 6. As apparent from the Table 6, the resin treatment is effective for improvement of the pilling resistance.

TABLE 6

| Test Period (hour) | Pilling Resistance (grade) After Resin Treatment: Cotton side | After Resin Treatment: Filament side | Before Resin Treatment: Cotton side | Before Resin Treatment: Filament side |
|---|---|---|---|---|
| 1 | 4–5 | 4–5 | 4 | 4–5 |
| 3 | 4 | 4 | 4 | 3–4 |
| 5 | 3–4 | 3–4 | 3–4* | 3 |
| 10 | 3–4 | 3–4 | 3–4* | 3 |
| 20 | 4 | 3–4 | 3–4* | 3 |

Remarks:
Marks * stand for test pieces showing a tendency to be somewhat nappy.

EXAMPLE 8

A starting fiber web of was prepared and subjected to a preliminary punching treatment in the same manner as Example 1 except that the preliminary punching treatment was carried out on each surface of the fiber web. Then, each surface of the web was subjected to a substantial punching treatment under a water pressure of 50 kg/cm$^2$. After drying, a resin treatment was carried out, whereby polyurethane resin was impregnated in the fiber web so that a weight ratio of fabric/resin was 78/22. Thereafter, a weakening treatment was carried out by a pressing action of a pair of rollers, each of which had a rough surface provided by an emery cloth of #150, under a nipping pressure of 40 kg/cm along a length of the roller. Further a second punching treatment was processed under a water pressure of 65 kg/cm$^2$. Thus-obtained non-woven fabric had a rich softness due to short fluff on the surface, and a good pilling resistance.

A blank was prepared by eliminating the weakening treatment from the above process and the tests were carried out on both fabrics. The results are listed in Table 7.

TABLE 7

| | Pilling Resistance (grade) 5 hr | 10 hr | Air Permeability (cc/cm$^2$/sec) | Stiffness (mm) width-wise | length-wise |
|---|---|---|---|---|---|
| Present Invention | 4–5 | 4 | 87 | 51 | 43 |
| Blank | 2 | 1 | 13 | 73 | 65 |

EXAMPLE 9

A starting fiber web of 65 g/m$^2$ was prepared from a filament of 1.3 denier of polyethylene-terephthalate. A preliminary punching treatment was carried out on each surface of the fiber web by a water jet punching unit (nozzle diameter: 0.14 mm, nozzle pitch: 1 mm) under a water pressure of 30 kg/cm$^2$. Then, the fiber web was subjected to a resin treatment, whereby a polyurethane resin of 18% in weight was impregnated therein. A weakening treatment was repeated three times by a pressing action of rollers, each of which had a rough surface provided by an emery cloth of #120, under a pressure of 60 kg/cm along a length of the roller. Subsequent thereto, a substantial punching treatment was carried out, whereby the final non-woven fabric was obtained. A blank was prepared by the above process except for elimination of the weakening treatment. The test results are listed in Table 8. As apparent from the Table, the non-woven fabric of the present invention was superior to the blank in pilling resistance, resiliency, and air-permeability.

TABLE 8

| | Pilling Resistance (grade) 5 hr | 10 hr | Air Permeability (cc/cm$^2$/sec) | Stiffness (mm) width-wise | length-wise |
|---|---|---|---|---|---|
| Present Invention | 4 | 3–4 | 92 | 47 | 38 |
| Blank | 1–2 | 1 | 28 | 64 | 53 |

We claim:

1. A method for producing a non-woven fabric suitable for clothing manufacture from a starting fiber web prepared by collecting a continuous filament of a synthetic fiber, comprising a weakening treatment, in which the starting fiber web is nipped between a roller system or a plate system, at least one element of the system having a rough surface provided by a plurality of particles of hard material so that weakened portions are imparted onto the filament constituting the surface of the fiber web, and a punching treatment, in which the fiber web is punched so that the filaments are entangled with each other.

2. A method for producing a non-woven fabric as defined by claim 1, wherein the rough surface of the element has a roughness in a range of from 1 μm to 5000 μm.

3. A method for producing a non-woven fabric as defined by claim 1, wherein the punching treatment is carried out by a water jet-punching, whereby the filament is broken at some of the weakened portions imparted by the weakening treatment and entangled with each other.

4. A method for producing a non-woven fabric as defined by claim 1 wherein a resin treatment is carried out on the fiber web at any stage after the starting fiber web is prepared.

5. A method for producing a non-woven fabric as defined by claim 4, wherein the resin treatment of the fiber web is carried out at any stage prior to the punching treatment.

6. A method for producing a non-woven fabric suitable for clothing use from a starting fiber web prepared by collecting a continuous filament of a synthetic fiber, wherein the starting fiber web is subjected to the following treatments of:

a first punching treatment for providing a provisional entanglement between the filaments, a resin treatment for coating or impregnation of a resin in the fiber web, a weakening treatment for imparting weakened portions on the filament constituting at least one surface of the fiber web by a nipping action of a roller system or a plate system, at least one element of the system having a rough surface provided by a plurality of particles of hard material, and a second punching treatment for breaking the filament at some of the weakened portions and providing a substantial entanglement between the filaments.

7. A method for producing a non-woven fabric as defined by claim 4, wherein the resin is polyurethane.

* * * * *